US007272875B2

(12) United States Patent
Bovard et al.

(10) Patent No.: US 7,272,875 B2
(45) Date of Patent: Sep. 25, 2007

(54) DECORATIVE COVER FOR CASKET SHELL FLANGE

(75) Inventors: Christopher C. Bovard, Sunman, IN (US); Gary Cunningham, Greensburg, IN (US); Bryan M. Hankel, Batesville, IN (US); Donald Maple, Batesville, IN (US); Daniel J. Parker, Connersville, IN (US); Paul M. Schnepp, Columbus, IN (US); Greg Wray, Guilford, IN (US)

(73) Assignee: Batesville Services, Inc., Batesville, IN (US)

( * ) Notice: Subject to any disclaimer, the term of this patent is extended or adjusted under 35 U.S.C. 154(b) by 330 days.

(21) Appl. No.: 11/096,527

(22) Filed: Apr. 1, 2005

(65) Prior Publication Data

US 2005/0268440 A1 Dec. 8, 2005

Related U.S. Application Data

(63) Continuation-in-part of application No. 10/686,373, filed on Oct. 15, 2003, now Pat. No. 7,069,627.

(51) Int. Cl.
*A61G 17/00* (2006.01)

(52) U.S. Cl. ..... 27/19

(58) Field of Classification Search ..... 27/19, 27/17, 2, 4, 6, 7; D99/8, 10
See application file for complete search history.

(56) References Cited

U.S. PATENT DOCUMENTS

| | | | |
|---|---|---|---|
| 1,500,141 | A | 7/1924 | MacDonald |
| 1,977,584 | A | 10/1934 | Hansen |
| 2,250,704 | A | 7/1941 | Donnelly |
| 2,943,376 | A | 7/1960 | Beshuk |
| 3,218,688 | A | 11/1965 | Slaughter |
| 3,233,302 | A | 2/1966 | Ross |
| 3,810,281 | A | 5/1974 | Ferber |
| 3,892,417 | A | 7/1975 | Clayton |
| 4,003,109 | A | 1/1977 | Matichak |
| 4,882,821 | A | 11/1989 | Sims, Jr. |
| 4,930,197 | A | 6/1990 | McClive |
| 5,639,072 | A | 6/1997 | McCall |
| 5,740,592 | A | 4/1998 | Lau |
| 5,970,590 | A | 10/1999 | Tambussi |
| 5,974,640 | A | 11/1999 | Vosahlik et al. |
| 6,019,336 | A | 2/2000 | Havens |
| 6,378,831 | B1 | 4/2002 | Copeland, Jr. |
| 6,438,249 | B1 | 8/2002 | Wiener |

FOREIGN PATENT DOCUMENTS

| | | |
|---|---|---|
| EP | 0 776 619 A1 | 6/1997 |

*Primary Examiner*—William L. Miller
(74) *Attorney, Agent, or Firm*—Wood, Herron & Evans, LLP

(57) ABSTRACT

A casket comprises a shell having a pair of opposed side walls, a pair of opposed end walls, and an upwardly facing flange, a lid closeable upon the edge of the shell, and a cover securable to the shell and concealing the flange when the lid is open, the cover being at least semi-rigid, the cover having a one-piece right angle section and a straight section.

34 Claims, 7 Drawing Sheets

DECORATIVE COVER FOR CASKET SHELL FLANGE

RELATED APPLICATIONS

Figure 1:
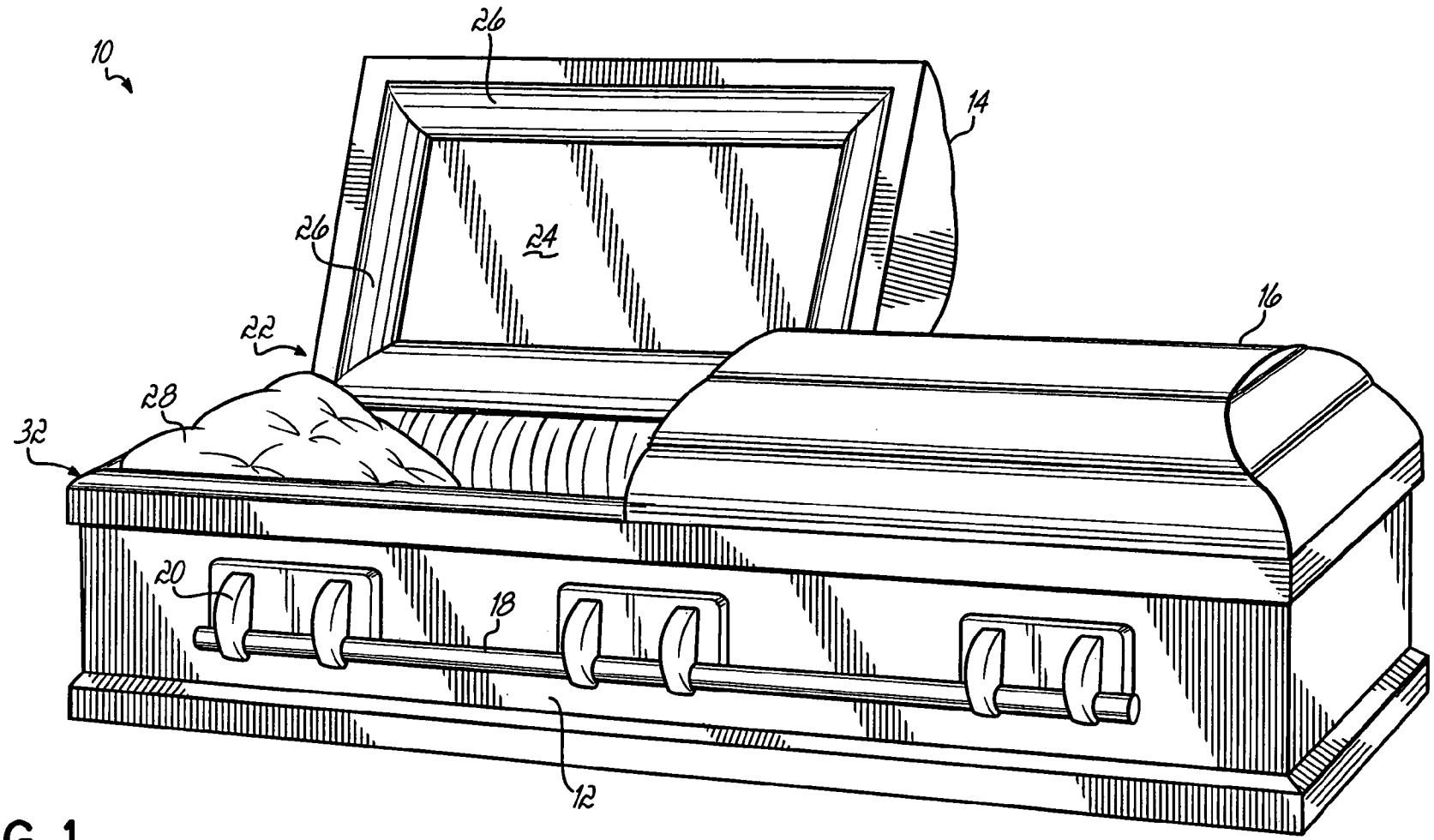

This application is a continuation-in-part of U.S. application Ser. No. 10/686,373 filed Jan. 15, 2003 now U.S. Pat. No 7,069,627, hereby incorporated by reference herein as if fully set forth in its entirety.

FIELD OF THE INVENTION

This invention relates generally to the death care industry, and more particularly to caskets and decorative treatments therefor.

BACKGROUND OF THE INVENTION

Caskets, whether fabricated of wood or metal, have traditionally been provided with attractive exteriors. Finely polished wood and metal finishes are typically provided for wood and metal caskets, respectively. Further, caskets have traditionally been provided with decorative exterior hardware, for example, decorative carrying handle bars and decorative "ears" or "escutcheons" covering the attachment points of the handle bars to the casket shell. Still further, caskets are typically provided with decorative corner ornaments mounted to the corners of the casket shell.

Caskets have also traditionally been outfitted with decorative interiors. These interiors have taken the form of a decorative cap panel and peripheral puffing mounted in the underside of the casket cap or lid, a pillow, and shirred or other decorative fabric lining the interior side walls and head end end wall of the casket shell. In addition, the side wall of the casket shell opposite the hinge connection of the cap to the shell, as well as the head end end wall of the casket shell, typically carry an additional, larger, piece of shirred or other decorative fabric for overlaying the top edge of the casket shell during periods when the casket cap is opened for presentation and viewing of the deceased. The smaller decorative fabric portions which line the interior side walls and head end end wall of the casket shell are each known as a "small body," whereas the larger piece of decorative fabric which is placed over the casket shell edge during presentation and viewing is known as the "big body." The big body thus provides a means for concealing the shell upper edge or flange during presentation and viewing, presenting a finished look. In the case of "sealer" metal caskets which carry a rubber flange gasket on the shell edge to provide a seal between shell and cap, the big body conceals the gasket. Polyester or other batting material is typically included in the small and big bodies in order to provide firmness, fullness, etc.

A drawback to the traditional fabric big body is that, when deployed over the edge of the casket shell during presentation and viewing, it tends to hang down over a portion or all of the decorative escutcheons, corner ornaments and/or decorative surface, of the casket shell. It is therefore desirable to provide a decorative cover treatment for the casket shell edge, which does not conceal these decorative features of the casket shell.

Another drawback to the traditional fabric big body is that it has a bulky, dated appearance. It is therefore desirable to provide a more contemporary look to the casket by eliminating the current bulky big body.

Yet another drawback to the traditional fabric big body is that it requires time intensive, tedious manual smoothing, straightening and/or manipulation of the fabric to present the best appearance of the big body, due to the flaccid nature of the fabric. It is therefore desirable to provide a decorative cover treatment for the casket shell edge, which does not require such attention.

SUMMARY OF THE INVENTION

The present invention is a casket comprising a shell having a pair of opposed side walls, a pair of opposed end walls, and an upwardly facing flange, a lid closeable upon the edge of the shell, and a cover securable to the shell and concealing the flange when the lid is open, the cover being at least semi-rigid, the cover having a one-piece right angle section and a straight section.

The right angle section can have a miter joint integrally formed therewith. The cover can have attachment structure for securing the right angle section and straight section together. The attachment structure can be an extension associated with either the right angle section or the straight section, which is received in the other of the right angle section and the straight section. The right angle section and the straight section can each have a curved outer surface. The curved outer surface of the right angle section and the curved outer surface of the straight section have equal radii of curvature. The extension can have a curved outer surface. The curved outer surface of the extension can have a radius of curvature less than the radii of curvature of the right angle section and the straight section. The extension can be integrally formed with the straight section. An end of the right angle section can have upturned side edges which receive side edges of the extension. The cover can have attachment structure for securing at least one of the right angle section and the straight section to the flange. The attachment structure can be a locking tab. The locking tab can lock into a wedge bar hanger mounted in the flange for supporting a wedge bar of a wedge bar locking mechanism. The locking tab can have teeth on opposed side edges for gripping an inner diametral edge of the wedge bar hanger. The attachment structure can be a locking hook. The locking hook can have an upturned end which locks underneath a wedge bar of a wedge bar locking mechanism.

The cover can have a one-piece right angle section and a pair of straight sections. The right angle section can have a miter joint integrally formed therewith. The cover can have attachment structure for securing the right angle section and straight sections together. The attachment structure can be an end portion of each straight section which is received in a respective end portion of the right angle section. The right angle section and the straight sections can each have a curved outer surface. The curved outer surface of the right angle section can have a radius of curvature which is greater than a radius of curvature of the straight sections. The right angle section can have a base portion with a hole therein whereby the right angle section can be secured to the flange with a fastener.

In another aspect, the present invention is a casket comprising a shell having a pair of opposed side walls, a pair of opposed end walls, and an upwardly facing flange, a lid closeable upon the edge of the shell, and a cover securable to the shell and concealing the flange when the lid is open, the cover being at least semi-rigid, the cover having a cloth covering secured thereto, the cloth covering having a longitudinal edge secured to the flange, whereby the cover can be pivoted to and between a stored position in the shell and a display position overlying the flange.

The flange can include an interior channel therein, and the longitudinal edge of the cloth covering can be secured to the channel. Cordage can be inserted in the channel, and the longitudinal edge of the cloth covering can be stapled to the cordage.

In another aspect, the present invention is a casket comprising a shell having a pair of opposed side walls, a pair of opposed end walls, and an upwardly facing flange, a lid closeable upon the edge of the shell, and a cover securable to the shell and concealing the flange when the lid is open, the cover being at least semi-rigid, the cover having a one-piece right angle section having a miter joint integrally formed therewith.

In another aspect, the present invention is a casket comprising a shell having a pair of opposed side walls, a pair of opposed end walls, and an upwardly facing flange, a lid closeable upon the edge of the shell, decorative hardware on the shell, and a cover securable to the shell and concealing the flange when the lid is open, the cover being at least semi-rigid, the cover having a one-piece right angle section having a miter joint integrally formed therewith and a pair of straight sections, the decorative hardware and one-piece right angle section having the same decorative surface ornamentation thereon.

The straight sections can have a decorative surface ornamentation which contrasts with the decorative surface ornamentation of the one-piece right angle section. The one-piece right angle section can have a metallic-like decorative surface ornamentation and the straight sections can have a wooden-like decorative surface ornamentation. The one-piece right angle section can have a metallic-like decorative surface ornamentation and the straight sections can have a fabric-like decorative surface ornamentation.

These and other features and advantages of the present invention will become more readily apparent during the following detailed description taken in conjunction with the drawings herein, in which:

BRIEF DESCRIPTION OF THE DRAWINGS OF THE INVENTION

Figure 2A:
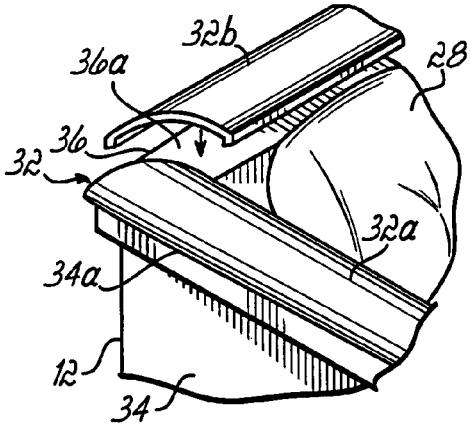
Figure 2B:
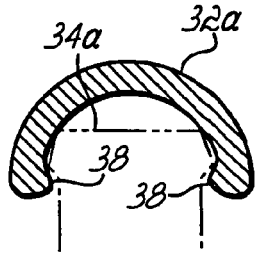
Figure 3A:
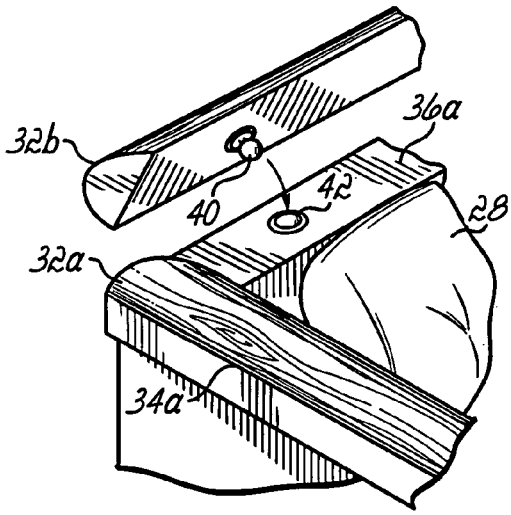
Figure 3B:
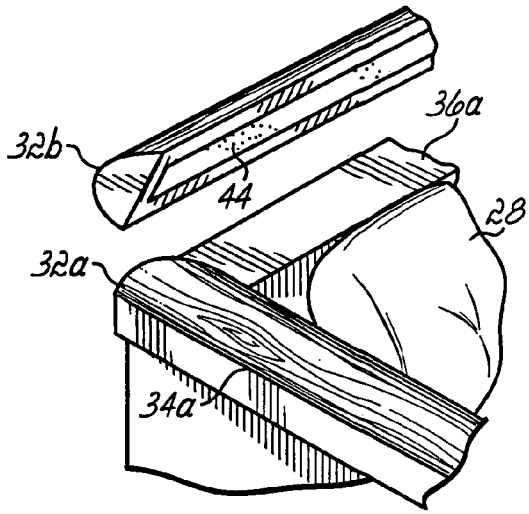
Figure 3C:
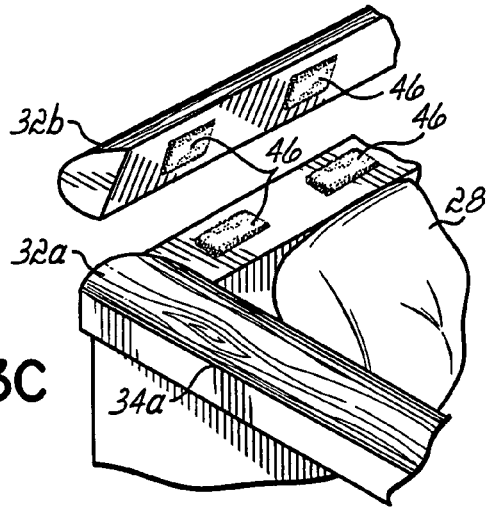
Figure 4:
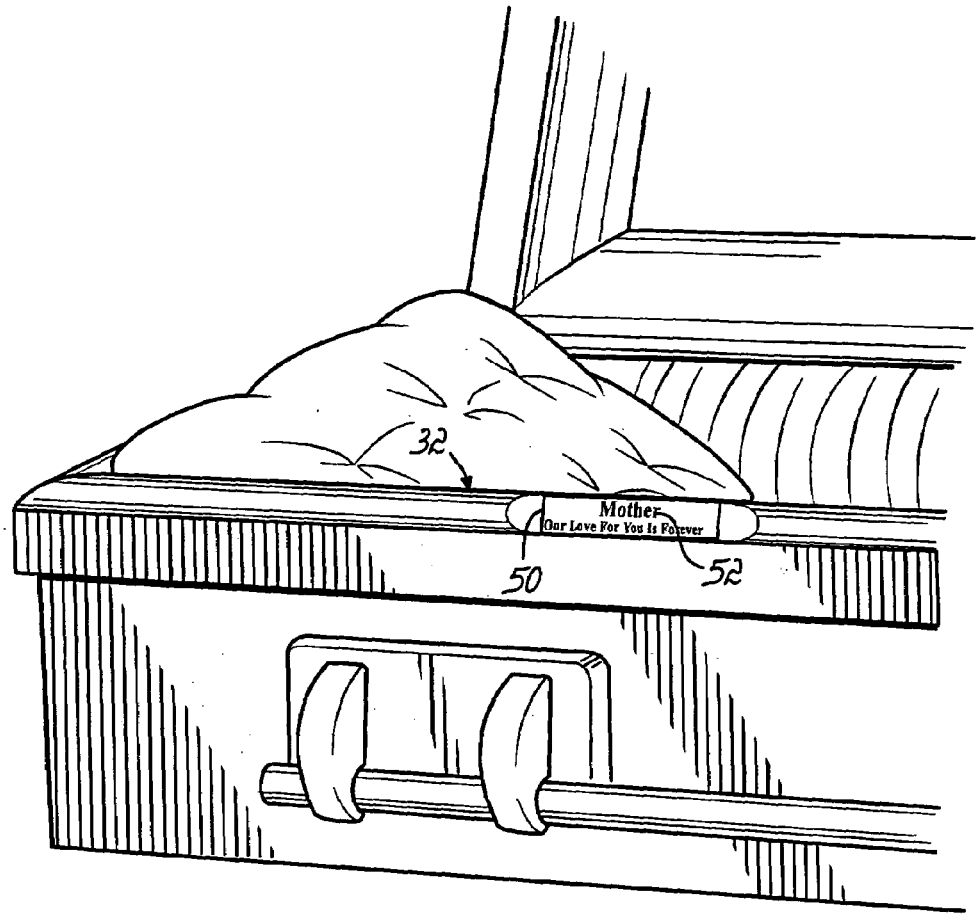
Figure 5:
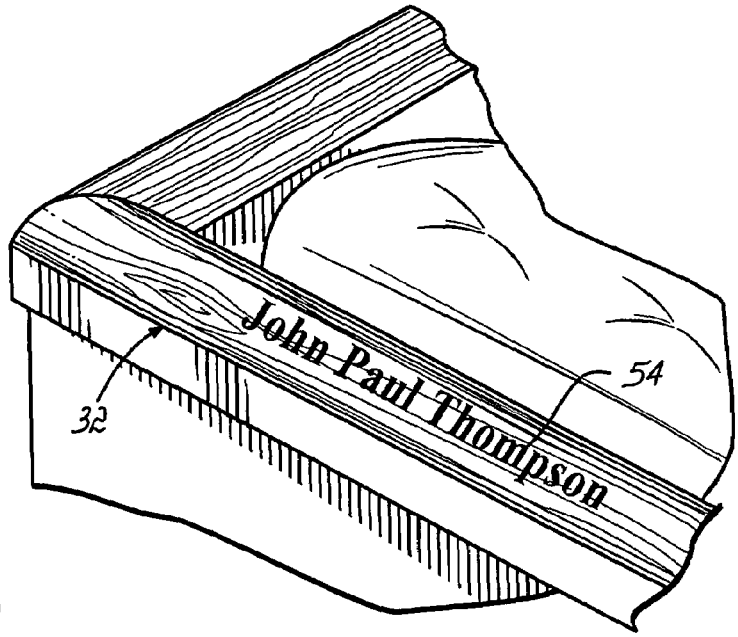
Figure 6:
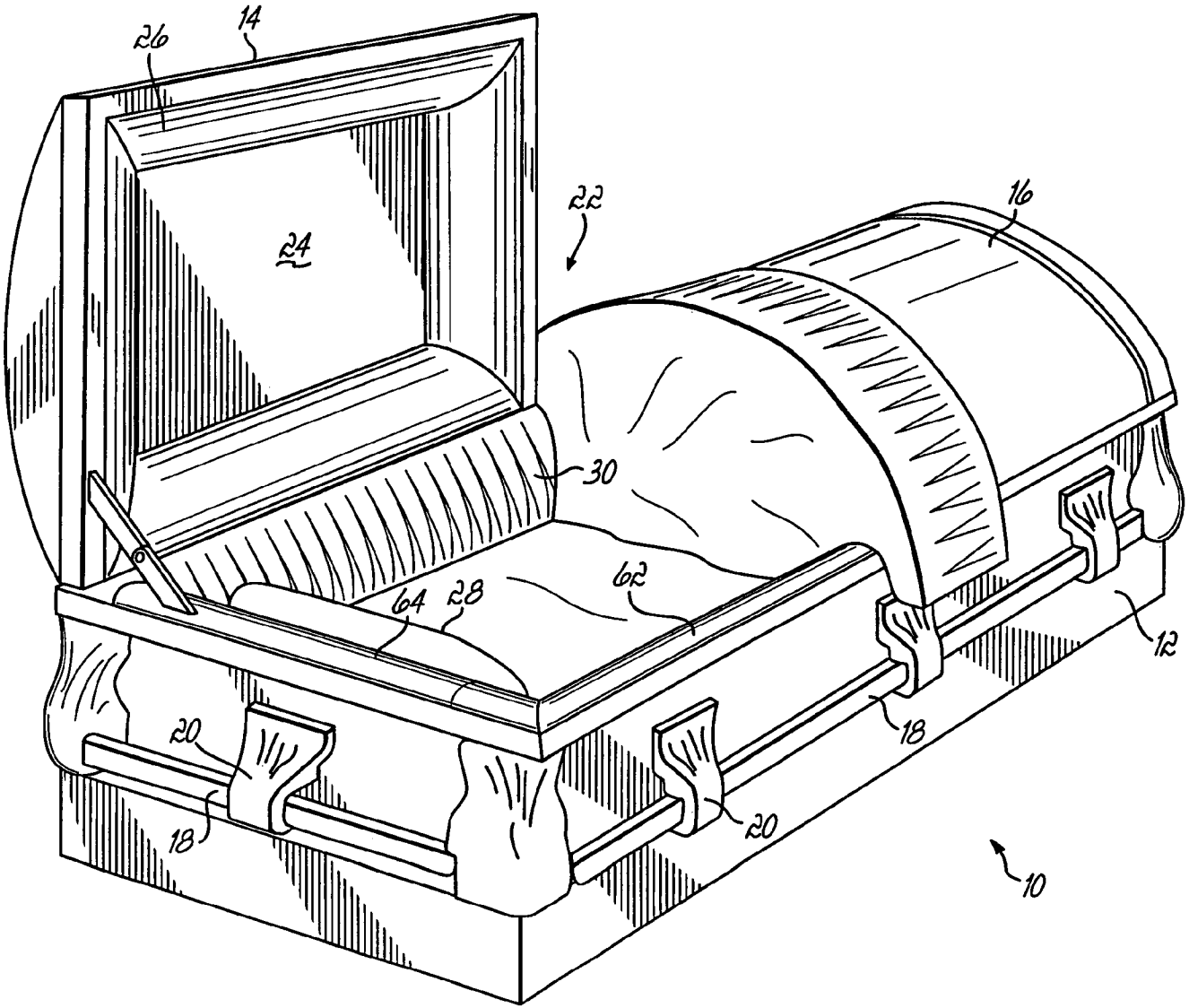
Figure 7:
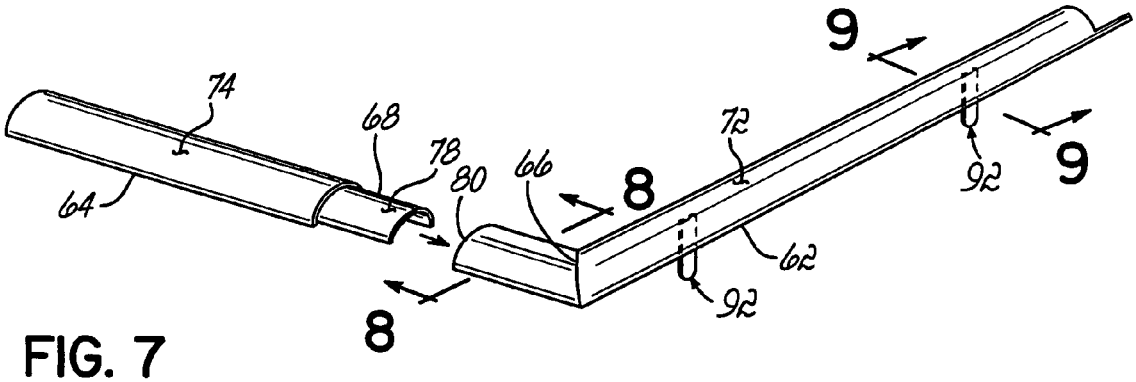
Figure 8:
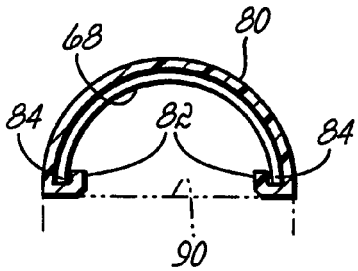
Figure 9:
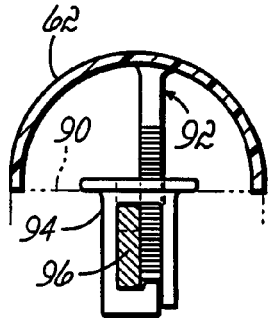
Figure 10:
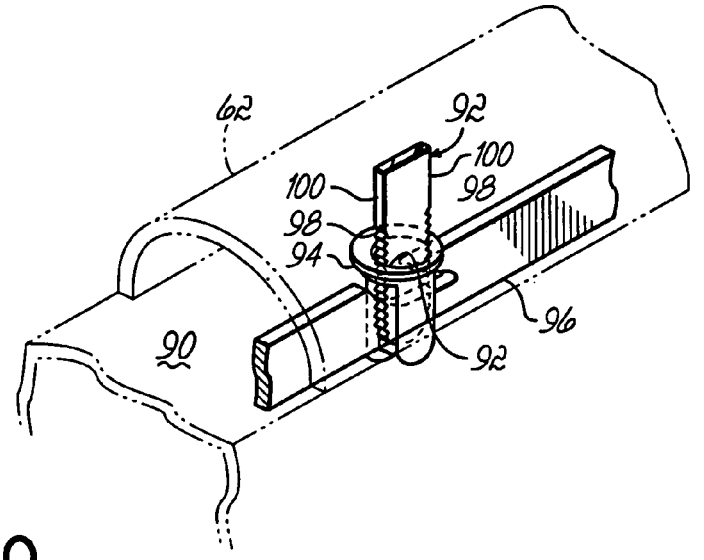
Figure 11:
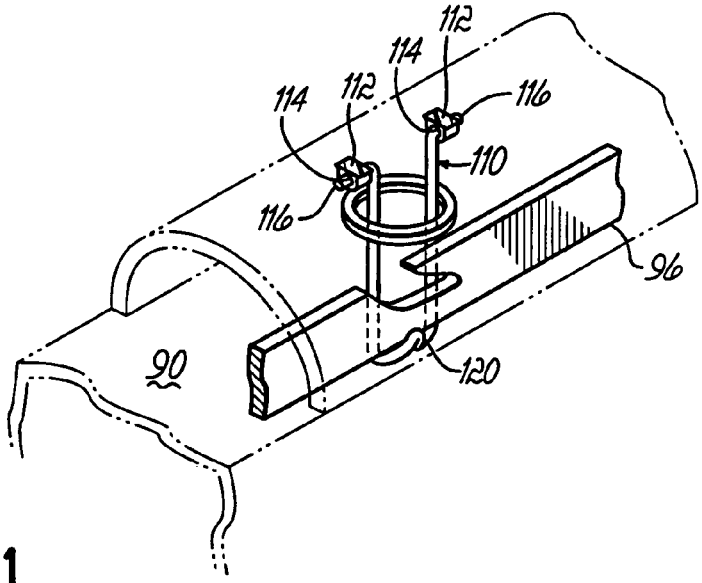
Figure 12:
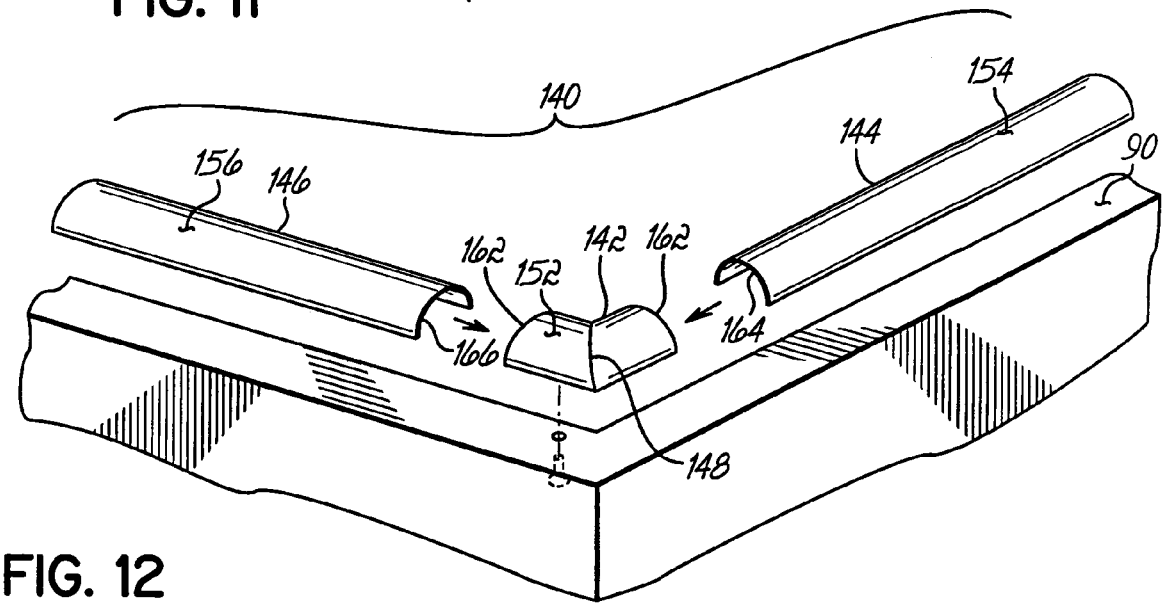
Figure 13:
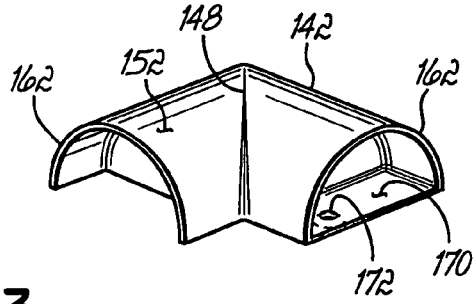
Figure 14:
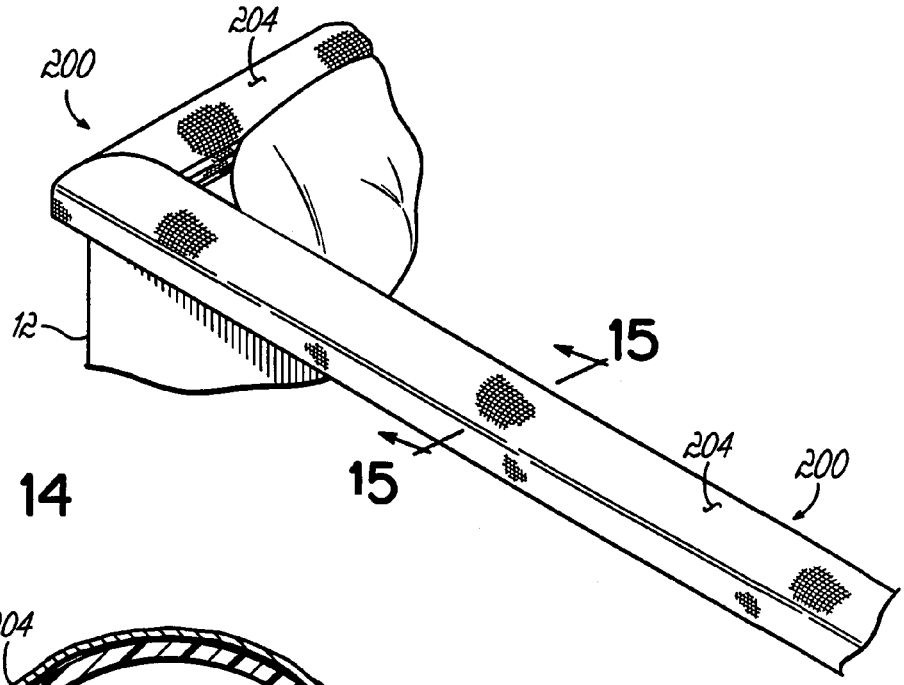
Figure 15:
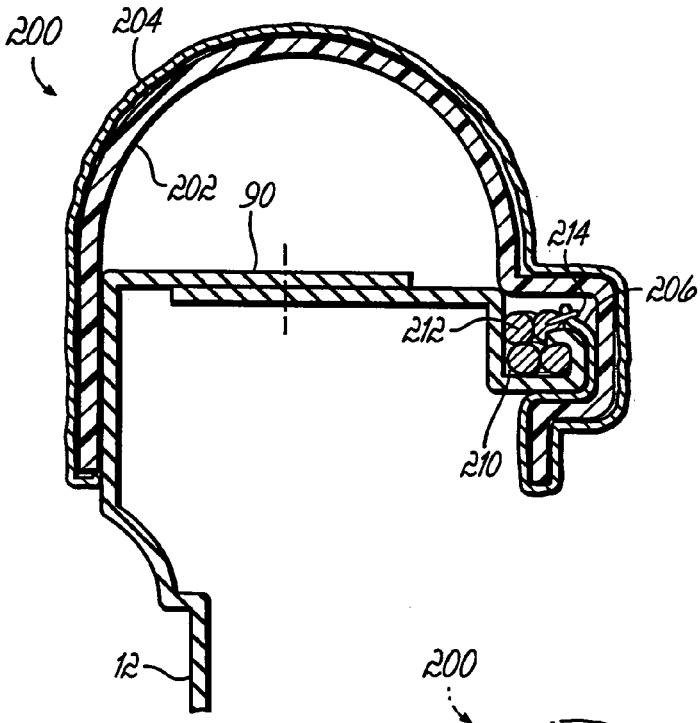
Figure 15A:
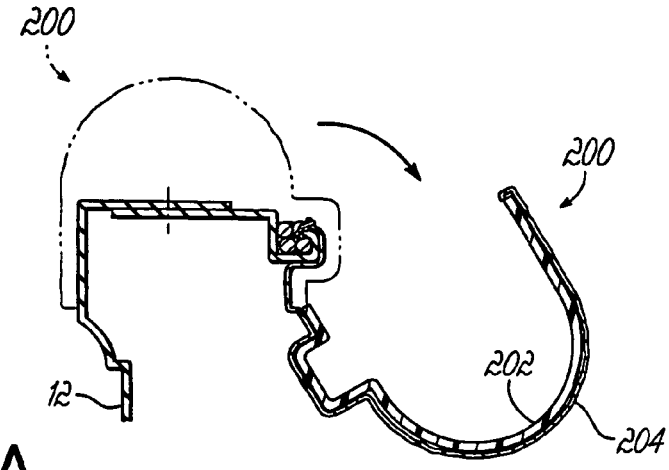

FIG. 1 is a perspective view of a casket with shell edge covers;

FIG. 2A is an enlarged partial perspective view of one corner of the casket with shell edge covers of FIG. 1, FIG. 2B is a view taken along 2B-2B of FIG. 1 illustrating one means of securing the shell edge covers to the shell edge, FIG. 3A is a view similar to FIG. 2A illustrating another means of securing the shell edge covers to the shell edge, FIG. 3B is a view similar to FIG. 3A illustrating yet another means of securing the shell edge covers to the shell edge, FIG. 3C is a view similar to FIG. 3B illustrating still another means of securing the shell edge covers to the shell edge, FIG. 4 is a partial perspective view of a casket with a wood shell edge cover including engraved name plate, FIG. 5 is a partial perspective view of a casket with an engraved wood shell cover, FIG. 6 is a perspective view of a casket with another embodiment of shell edge cover, FIG. 7 is an exploded perspective view of the shell edge covers of FIG. 6, FIG. 8 is a view taken along line 8-8 in FIG. 7, FIG. 9 is a view taken along line 9-9 in FIG. 7, FIG. 10 is a perspective view of the portion of the shell edge cover shown in FIG. 9, FIG. 11 is a perspective view of another embodiment of shell edge cover, FIG. 12 is a perspective view of another embodiment of shell edge cover, FIG. 13 is an enlarged perspective view of the corner connector of the shell edge cover of FIG. 12, FIG. 14 is a perspective view of another embodiment of shell edge cover, FIG. 15 is a view taken along line 15-15 in FIG. 14, and FIG. 15A is a view similar to FIG. 15 but with the shell edge cover pivoted to a storage position within the shell.

DETAILED DESCRIPTION OF A PREFERRED EMBODIMENT OF THE INVENTION

Referring first to FIG. 1, there is illustrated a casket 10 of this invention. The casket 10 can be fabricated from any suitable material suitable for above ground interment, in ground burial or cremation, such as wood, metal, plastic, cardboard, fiberboard etc., and includes a lower body containing portion or shell 12, a head end cap or lid 14 which can be pivoted to a rear upper edge of the shell 12 and a foot end cap or lid 16 which likewise can be pivoted to the rear upper edge of the shell 12. Casket 10 could just as well be of the so-called "full couch" type, having only a single, full-length cap or lid. Casket 10 can also include carrying handle bars 18 and decorative escutcheons 20 covering the interconnections of the handle bars 18 to the shell 12.

The casket 10 can also include a decorative interior 22, including a cap panel 24 with a peripheral puffing 26 therearound, mounted to the underside of the head end cap 14. Cap panel 24 and puffing 26 can be fabricated of fabric-covered sheet-like material ("chipboard"). Interior 22 can further include a pillow 28 (with or without a pillow "case"), and "shirred" or other decorative fabric portions 30 lining the interior walls of the casket shell 12 and known as a "small body."

In stark contrast to previous casket decorative interiors, the interior 22 of the FIG. 1 casket 10 does not include the additional, larger piece of shirred or other decorative fabric, known as a "big body," for overlaying the top edge of the casket shell during periods when the casket cap 14 is opened for presentation and viewing of the deceased. Rather, the casket 10 includes a rigid or semi-rigid decorative shell edge cover 32, the edge cover 32 being rigid or semi-rigid as compared to a traditional flaccid fabric big body.

Referring now to FIG. 2A, it will be seen that shell 12 includes a side wall 34 and a head end end wall 36. Each side wall 34 and head end end wall 36 includes a respective upper edge 34*a*, 36*a*, respectively. Collectively upper edges 34*a*, 36*a* form an upper edge or flange of shell 12. Decorative shell edge cover 32 is illustrated as having been fabricated in two mitered parts, a side portion 32*a* and an end portion 32*b*. As illustrated, the edge cover 32 is elongated, being relatively narrow in comparison to its length, and preferably conceals only the edge of the shell 12, i.e. is preferably no wider than the upwardly flange or edge of the shell 12. Edge cover 32 is preferably fabricated from a rigid, or at least semi-rigid, material, such as plastic, cardboard, wood or metal; edge cover 32 could even be fabricated from simply a strip of heavily starched fabric so as to be semi-rigid. A plastic edge cover 32 could be fabricated by, for example, molding or extruding. If cardboard, edge cover 32 could be covered with decorative fabric, painted or otherwise printed with decorative surface ornamentation.

Referring now to FIG. 2B, one example of a means for removably securing the shell edge cover 32 to the shell 12 is illustrated. In this embodiment, the cover 32 material is selected and the cover 32 itself is configured such that the resilience of the cover 32 allows it to snap onto the shell edge. For example, the cover 32 in FIG. 2B could be fabricated of plastic, cardboard, wood or sheet metal. Including inwardly directed extensions 38, 38 help to retain the cover 32 on the shell edge.

Referring now to FIGS. 3A-C, various other alternative means for removably securing the cover 32 to the shell 12 are illustrated. As another example, and referring now to FIG. 3A, the cover 32 and shell edge can include cooperating studs 40 and apertures 42, with either the cover 32 or the shell 12 carrying the studs 40 and the other having the apertures 42 therein which accept the studs 40. As yet another example, and referring now to FIG. 3B, the cover 32 and shell edge can utilize double-sided tape 44 to adhere one to another. As still another example, and referring now to FIG. 3C, the cover 32 and shell edge can utilize a hook and loop fastener 46 to secure one to another.

Referring now to FIGS. 4 and 5, a personalized edge cover 32 is illustrated. In FIG. 4, the edge cover 32 includes an engraveable plate 50 bearing an inscription of memorialization 52 engraved thereon. In FIG. 5, an edge cover 32 is illustrated which itself is engraved with an inscription of memorialization 54 thereon.

Referring now to FIGS. 6-15A, there are illustrated a number of alternative embodiments of the shell edge cover of the present invention. Referring first to FIG. 6, and with like numbers representing like elements, casket 10 has a rigid or semi-rigid decorative shell edge cover 60, the edge cover 60 being rigid or semi-rigid as compared to a traditional flaccid fabric big bod, and having a one-piece right angle section 62 and a straight section 64. As in the prior embodiment, the edge cover 60 is preferably fabricated from a rigid, or at least semi-rigid, material, such as plastic, cardboard, wood or metal; edge cover 60 could even be fabricated from simply a strip of heavily starched fabric so as to be semi-rigid. A plastic edge cover 60 could be fabricated by, for example, molding or extruding. If cardboard, edge cover 60 could be covered with decorative fabric or film, painted or otherwise have decorative surface ornamentation applied thereto.

Referring now to FIGS. 7-11, right angle section 62 can have a miter joint 66 integrally formed therewith. Such a joint can be readily formed via molding or extruding a plastic edge cover 60, and avoids the difficulties of forming the miter joint from two mitered edge cover sections. One of the sections 62, 64, for example straight section 64, can have attachment structure 68 for securing the two sections together. The attachment structure 68 can be an extension of one of the sections which is received in the other section. The sections 62, 64 can each have a curved outer surface 72, 74, respectively. The extension 68 can likewise have a curved outer surface 78. The curved outer surfaces 72, 74 of the sections 62, 64 can have the same radius of curvature so that when assembled the abutting end edges of the sections 62, 64 are visually minimized. The outer surface 78 of extension 68 can have a radius of curvature less than that of the surfaces 72, 74 of the sections 62, 64 so as to readily telescope thereinto (FIGS. 7 and 8). The end 80 of the right angle section 62 can have upturned side edges 82, 82 which receive the side edges 84, 84 of the extension 68.

Referring now to FIGS. 9-11, the edge cover 60 can have attachment structure attaching either or both of the sections 62, 64 to the flange 90 of the shell 12. For example, either of both of the sections 62, 64 can have one or more locking tabs 92. Locking tabs 92 can be integrally formed with either or both of the sections 62, 64 and can extend downwardly from the interior roof(s) of those section(s). The locking tabs 92 can lock into a wedge bar hanger 94 mounted in the flange 90 for supporting a wedge bar 96 of a wedge bar locking mechanism. For examples of wedge bar locking mechanism, see the assignee's U.S. Pat. Nos. 5,503,439 and 6,154,938, both of which are hereby incorporated by reference herein as if fully set forth in their entirety. The locking tab 92 can have teeth 98 on opposed side edges 100, 100 thereof for gripping in inner diametral edge 102 of the wedge bar hanger 94.

Alternatively, and referring now to FIG. 11, the attachment structure can be a locking hook 110. Locking hook 110 can be fabricated of, for example, wire. As with locking tab 92, locking hook 110 can extend downwardly from the interior roof(s) of those section(s). A pair of hanger supports 112, 112 can be integrally formed with the section(s) 62 and/or 64. Each hanger support 112, 112 can have a hole 114 therethrough which can accept an upper end 116 of a respective leg of the locking hook 110. The hook 110 can include an upturned end 120 which locks underneath the wedge bar 96 of a wedge bar locking mechanism.

Referring now to FIGS. 12 and 13, another version of shell cover 140 is illustrated. In this version, the cover 140 can have a one-piece right angle section 142 and a pair of straight sections 144, 146. Similar to the prior embodiment, right angle sections 142 can have a miter joint 148 integrally formed therewith. Also similar to the prior embodiment, the right angle section 142 and the straight sections 144, 146 all can have curved outer surfaces 152, 154, 156. The curved outer surface 152 of the right angle sections 142 can have a radius of curvature which is greater than the radius of curvature of the curved outer surfaces 154, 156 of the straight sections 144, 146, such that an end portion 164, 166 of the straight sections 144, 146 can be received in respective end portions 162, 162 of the right angle section 142. Right angle section 142 can include a base portion 170 with a hole 172 therein whereby the right angle section 142 can be secured to the shell flange 90 with a fastener.

The decorative hardware of the casket 10, for example, carrying handle bars 18 and/or decorative escutcheons 20 covering the interconnections of the handle bars 18 to the shell 12 and/or decorative shell corner ornaments, and the one-piece right angle section 142, can have the same decorative surface ornamentation thereon to provide a distinctive appearance. The decorative surface ornamentation of these items can be metallic-like, either due to the items actually being fabricated of metal, or due to the items being fabricated of, for example, metallized plastic (plastic coated with metal or metal film or metal-like film). In addition, the straight sections 144, 146 can have a decorative surface ornamentation which contrasts with the decorative surface ornamentation of the one-piece right angle section 142. For example, the one-piece right angle section 142 can have a metallic-like decorative surface ornamentation and the straight sections 144, 146 can have a wooden-like decorative surface ornamentation. Or, the one-piece right angle section 142 can have a metallic-like decorative surface ornamentation and the straight sections 144, 146 can have a fabric-like decorative surface ornamentation.

Referring now to FIGS. 14-15A, there is illustrated yet another embodiment of shell edge cover 200 according to the present invention. In this embodiment, the shell edge cover 200 includes a semi-rigid base portion 202 to which is attached a decorative fabric or cloth covering 204. The cloth covering 204 has a longitudinal edge 206 which is secured to the flange 90 of the shell 12. In this way, the cover 200 can be pivoted to and between a stored position in the shell 12 (FIG. 15A), and a display position overlying the flange 90 (FIG. 15). The flange 90 can include an interior channel 210 therein and the longitudinal edge 206 of the cloth covering 204 can be secured to the channel 210. For example, cordage 212 such as cord, rope, or the like can be inserted into the channel 210, and the longitudinal edge 206 of the cloth covering 204 can be stapled thereto with staples 214. Due to the geometry of this embodiment and its ability to be flipped inside the shell 12, the shell edge cover 200 would likely be fabricated as either two sections which have abutting ends forming a miter, or three sections (one right angle section and two straight sections), or possibly two sections wherein one is a right angle section and the other is a straight section.

Those skilled in the art will readily recognize numerous adaptations and modifications which can be made to the present invention which will result in an improved decorative cover for the flange of a casket shell, yet all of which will fall within the spirit and scope of the present invention as defined in the following claims. Accordingly, the invention is to be limited only by the scope of the following claims and their equivalents.

What is claimed is:

1. A casket comprising:

a shell having a pair of opposed side walls, a pair of opposed end walls, and an upwardly facing flange, a lid closeable upon said flange of said shell, and a cover securable to said shell and concealing said flange when said lid is open, said cover being at least semi-rigid, said cover having a one-piece right angle section and a straight section, wherein said cover has attachment structure for securing said right angle section and straight section together.

2. The casket of claim 1 wherein said right angle section has a miter joint integrally formed therewith.

3. The casket of claim 1 wherein said attachment structure is an extension associated with one of said right angle section and said straight section, which is received in the other of said right angle section and said straight section.

4. The casket of claim 3 wherein said right angle section and said straight section each have a curved outer surface.

5. The casket of claim 4 wherein said curved outer surface of said right angle section and said curved outer surface of said straight section have equal radii of curvature.

6. The casket of claim 5 wherein said extension has a curved outer surface.

7. The casket of claim 6 wherein said curved outer surface of said extension has a radius of curvature less than the radii of curvature of said right angle section and said straight section.

8. The casket of claim 7 wherein said extension is integrally formed with said straight section.

9. The casket of claim 8 wherein an end of said right angle section has upturned side edges which receive side edges of said extension.

10. The casket of claim 1 wherein said flange cover has attachment structure for securing at least one of said right angle section and said straight section to said flange.

11. The casket of claim 10 wherein said attachment structure is a locking tab.

12. The casket of claim 11 wherein said locking tab locks into a wedge bar hanger mounted in said flange for supporting a wedge bar of a wedge bar locking mechanism.

13. The casket of claim 12 wherein said locking tab has teeth on opposed side edges for gripping an inner diametral edge of said wedge bar hanger.

14. The casket of claim 10 wherein said flange attachment structure is a locking hook.

15. The casket of claim 14 wherein said locking hook has an upturned end which locks underneath a wedge bar of a wedge bar locking mechanism.

16. A casket comprising:

a shell having a pair of opposed side walls, a pair of opposed end walls, and an upwardly facing flange, a lid closeable upon said flange of said shell, and a cover securable to said shell and concealing said flange when said lid is open, said cover being at least semi-rigid, said cover has a one-piece right angle section and a pair of straight sections, wherein said cover has attachment structure for securing said right angle section and straight sections together.

17. The casket of claim 16 wherein said right angle section has a miter joint integrally formed therewith.

18. The casket of claim 16 wherein said attachment structure is an end portion of each said straight section which is received in a respective end portion of said right angle section.

19. The casket of claim 18 wherein said right angle section and said straight sections each have a curved outer surface.

20. The casket of claim 19 wherein said curved outer surface of said right angle section has a radius of curvature which is greater than a radius of curvature of said straight sections.

21. The casket of claim 20 wherein said right angle section has a base portion with a hole therein whereby said right angle section can be secured to said flange with a fastener.

22. A casket comprising:

a shell having a pair of opposed side walls, a pair of opposed end walls, and an upwardly facing flange, a lid closeable upon said flange of said shell, and a cover securable to said shell and concealing said flange when said lid is open, said cover being at least semi-rigid, said cover having a cloth covering secured thereto, said cloth covering having a longitudinal edge secured to said flange to pivot said cover between a stored position in said shell and a display position overlying said flange, wherein said flange includes an interior channel therein, and said longitudinal edge of said cloth covering is secured to said channel, and cordage inserted in said channel, said longitudinal edge of said cloth stapled to said cordage.

23. A casket comprising:

a shell having a pair of opposed side walls, a pair of opposed end walls, and an upwardly facing flange, a lid closeable upon said flange of said shell, and a cover securable to said shell and concealing said flange when said lid is open, said cover being at least semi-rigid, said cover having a one-piece right angle section having a miter joint integrally formed therewith, wherein said cover has attachment structure for securing said right angle section to said flange, and wherein said attachment structure is one of a locking tab and a locking hook.

24. The casket of claim 23 wherein said attachment structure is said locking tab.

25. The casket of claim 24 wherein said locking tab locks into a wedge bar hanger mounted in said flange for supporting a wedge bar of a wedge bar locking mechanism.

26. The casket of claim 25 wherein said locking tab has teeth on opposed side edges for gripping an inner diametral edge of said wedge bar hanger.

27. The casket of claim 23 wherein said attachment structure is said locking hook.

28. The casket of claim 27 wherein said locking hook has an upturned end which locks underneath a wedge bar of a wedge bar locking mechanism.

29. A casket comprising:

a shell having a pair of opposed side walls, a pair of opposed end walls, and an upwardly facing flange, a lid closeable upon said flange of said shell, decorative hardware on said shell, and a cover securable to said shell and concealing said flange when said lid is open, said cover being at least semi-rigid, said cover having a one-piece right angle section having a miter joint integrally formed therewith and a pair of straight sections, said decorative hardware and one-piece right angle section having the same decorative surface ornamentation thereon, wherein said cover has attachment structure for securing said right angle section and straight section together.

30. The casket of claim 29 wherein said straight sections have a decorative surface ornamentation which contrasts with the decorative surface ornamentation of said one-piece right angle section.

31. The casket of claim 30 wherein said one-piece right angle section has a metallic-like decorative surface ornamentation and said straight sections have a wooden decorative surface ornamentation.

32. The casket of claim 30 wherein said one-piece right angle section has a metallic decorative surface ornamentation and said straight sections have a fabric-like decorative surface ornamentation.

33. A casket comprising:

a shell having a pair of opposed side walls and a pair of opposed end walls, said walls defining an upper edge of said shell;

a lid closeable upon said edge of said shell; and a one-piece cover removably securable to said shell and concealing said edge when said lid is open, said cover being at least semi-rigid, said cover adapted to be removed from said shell edge for proper closing of said lid on said shell edge, and wherein said cover is removably secured to said shell via a press-fit connection between said cover and said shell edge, said cover having sufficient resilience and being configured such that said cover snaps onto said shell edge;

wherein said cover includes an engraveable plate mounted thereon.

34. A casket comprising:

a shell having a pair of opposed side walls and a pair of opposed end walls, said walls defining an upper edge of said shell;

a lid closeable upon said edge of said shell; and a one-piece cover removably securable to said shell and concealing said edge when said lid is open, said cover being at least semi-rigid, said cover adapted to be removed from said shell edge for proper closing of said lid on said shell edge, and wherein said cover is removably secured to said shell via a press-fit connection between said cover and said shell edge, said cover having sufficient resilience and being configured such that said cover snaps onto said shell edge;

wherein said cover is engraved with an inscription memorializing the deceased.

* * * * *

UNITED STATES PATENT AND TRADEMARK OFFICE

CERTIFICATE OF CORRECTION

PATENT NO. : 7,272,875 B2
APPLICATION NO. : 11/096527
DATED : September 25, 2007
INVENTOR(S) : Christopher C. Bovard et al.

It is certified that error appears in the above-identified patent and that said Letters Patent is hereby corrected as shown below:

Column 7, line 62, reads: "11. The casket of claim 10 wherein said attachment"; it should read -- 11. The casket of claim 10 wherein said flange attachment --.

Column 9, line 35, reads: "angle section has a metallic-like decorative surface orna-"; it should read -- angle section has a metallic decorative surface orna- --.

Column 9, line 40 reads: "tion and said straight sections have a fabric-like decorative"; it should read -- tion and said straight sections have a fabric decorative --.

Signed and Sealed this

Twenty-fifth Day of November, 2008

JON W. DUDAS
*Director of the United States Patent and Trademark Office*